US005887306A

United States Patent [19]

Huang

[11] Patent Number: 5,887,306

[45] Date of Patent: Mar. 30, 1999

[54] TOOL COMBINATION HAVING SCREW DRIVER AND KNIFE

[76] Inventor: Yung Hsu Huang, No. 10, Lane 38, Li Der Street, Taiping City, Taichung Hsien, Taiwan

[21] Appl. No.: 865,381

[22] Filed: May 29, 1997

[51] Int. Cl.[6] ..... B25B 23/16; B25G 1/08

[52] U.S. Cl. ..... 7/165; 81/177.4; 81/439

[58] Field of Search ..... 7/165, 158, 118; 81/177.2, 177.4, 177.6, 436, 490, 492, 437–439

[56] References Cited

U.S. PATENT DOCUMENTS

| | | | |
|---|---|---|---|
| 56,166 | 7/1866 | Boardman . | |
| 1,323,056 | 11/1919 | Hofmann | 7/165 X |
| 4,307,634 | 12/1981 | Gentry | 81/177.6 X |
| 4,635,309 | 1/1987 | Larsen | 7/158 |
| 5,038,435 | 8/1991 | Crawford et al. | 7/165 |
| 5,052,253 | 10/1991 | Lin | 81/177.4 X |
| 5,499,562 | 3/1996 | Feng | 81/177.4 |
| 5,511,261 | 4/1996 | Collins | 81/177.4 X |
| 5,517,885 | 5/1996 | Feng | 81/490 X |

*Primary Examiner*—D. S. Meislin

[57] ABSTRACT

A tool combination includes a chamber for slidably receiving a slide, and a driving stem secured to the slide for allowing the driving stem to be received in the chamber and to be extended outward of the chamber. A securing member is pivotally coupled to the slide for moving the slide along the chamber and for securing the slide in place. The securing member includes a casing for receiving tool bits and includes a cover having a catch for securing the securing member in place. The tool combination includes a side groove for slidably receiving a knife.

6 Claims, 5 Drawing Sheets

TOOL COMBINATION HAVING SCREW DRIVER AND KNIFE

BACKGROUND OF THE INVENTION

1. Field of the Invention

The present invention relates to a tool, and more particularly to a tool combination including both screw driver and knife.

2. Description of the Prior Art

Typical screw drivers include a driving stem that should be disengaged from the handle for allowing the driving stem to be engaged in the handle and for storing purposes. The knife may not be directly received in the handle. Typical screw drivers and knifes are two different tools that may not be combined together and that have never been combined together in a single tool, such that the users have to buy each of the tools.

The present invention has arisen to mitigate and/or obviate the afore-described disadvantages of the conventional tools.

SUMMARY OF THE INVENTION

The primary objective of the present invention is to provide a tool combination which includes a driving stem that may be easily engaged into the body and which includes both screw driver and knife.

In accordance with one aspect of the invention, there is provided a tool combination comprising a body including a chamber and including a front portion having an orifice, the chamber including a front end and a rear end, a slide slidably engaged in the chamber of the body for allowing the slide to move between the front end and the rear end of the chamber, a driving stem secured to the slide and moved in concert with the slide and slidably engaging with the orifice of the body for allowing the driving stem to be received in the body when the slide is moved to the rear end of the chamber and for allowing the driving stem to be extended outward of the body when the slide is moved to the front end of the chamber, and means for moving the slide along the chamber and for securing the slide to the body.

The body includes a space communicating with the chamber, the moving means includes a securing member pivotally coupled to the slide at a pivot shaft for allowing the securing member to be rotated relative to the slide about the pivot shaft, the securing member is engaged in the space for securing the slide to the body. The body includes a side portion having an opening, the securing member includes a catch for engaging with the opening and for securing the securing member to the body. The securing member includes a casing having a plurality of depressions for receiving tool bits and having a cover for enclosing the depressions.

The body includes a rear portion having at least one notch and having a puncture, and includes a cap having at least one protrusion for engaging with the at least one notch and having a projection for engaging with the puncture and for allowing the cap to be secured to the body. The cap includes at least one slot for engaging with a wood screw. The body includes a side portion having a groove, and includes a knife slidably engaged in the groove, the knife includes a knob for moving the knife along the groove.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
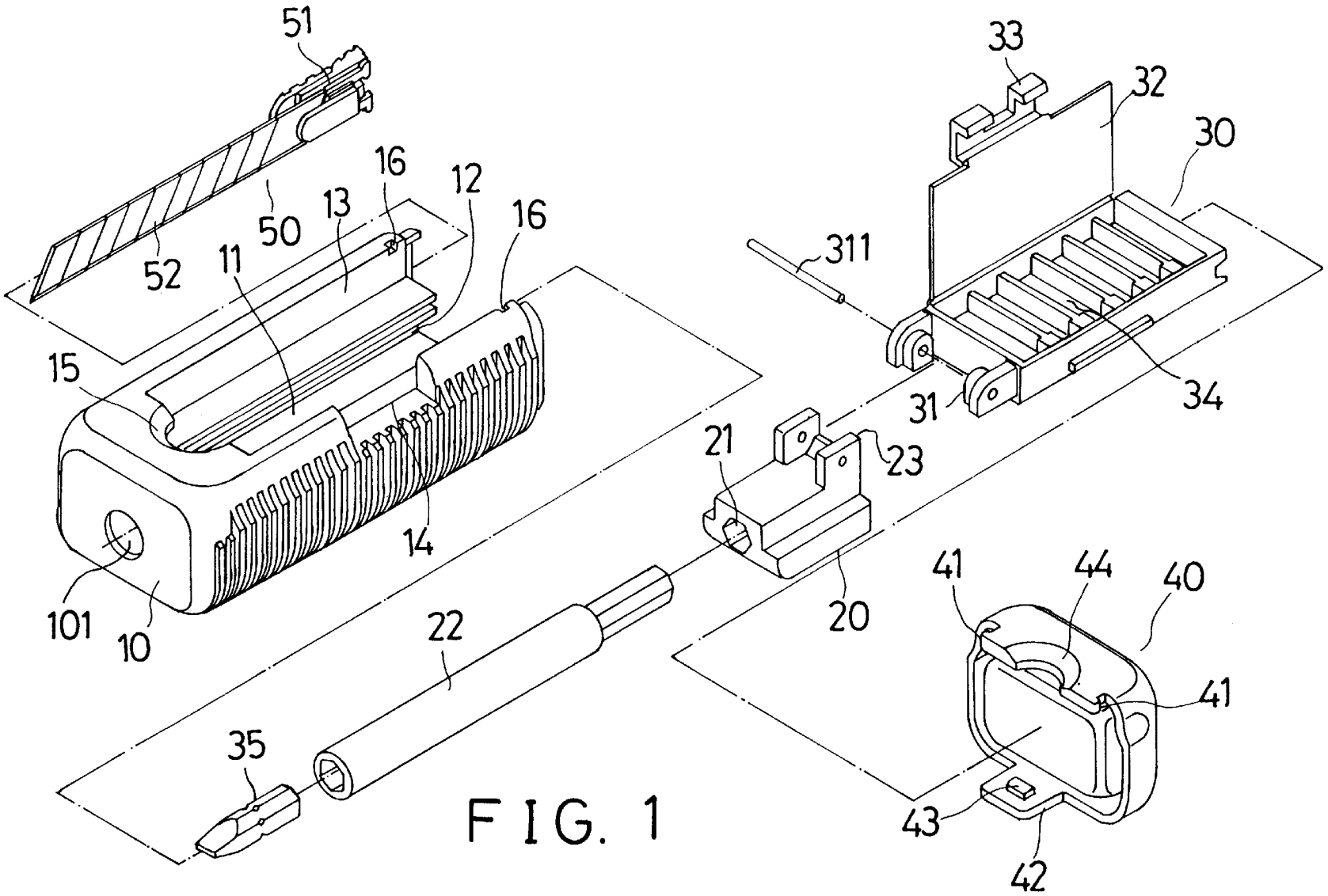
FIG. 1 is an exploded view of a tool combination in accordance with the present invention.

Referring to the drawings, and initially to FIGS. 1 to 4, a tool combination in accordance with the present invention comprises a body 10 including a chamber 11 and a pair of channels 12 for slidably receiving a slide 20 and including a space 13 communicating with the chamber 11. The body 10 includes an orifice 101 formed in the front end and communicating with the chamber 11. The body 10 includes a side opening 14 communicating with the space 13, and includes a recess 15 formed in the front portion, and includes two notches 16 and a puncture 17 (FIGS. 3, 5, and 6) formed in the rear portion for engaging with a cap 40. The cap 40 includes a flap 42 for engaging with the bottom portion of the body 10 and includes a projection 43 for engaging with the puncture 17 and includes two protrusions 41 for engaging with the notches 16 of the body 10 and for allowing the cap 40 to be secured to the body 10 and for allowing the cap 40 to be easily disengaged from the body 10. The cap 40 also includes a recess 44.

Figure 2:
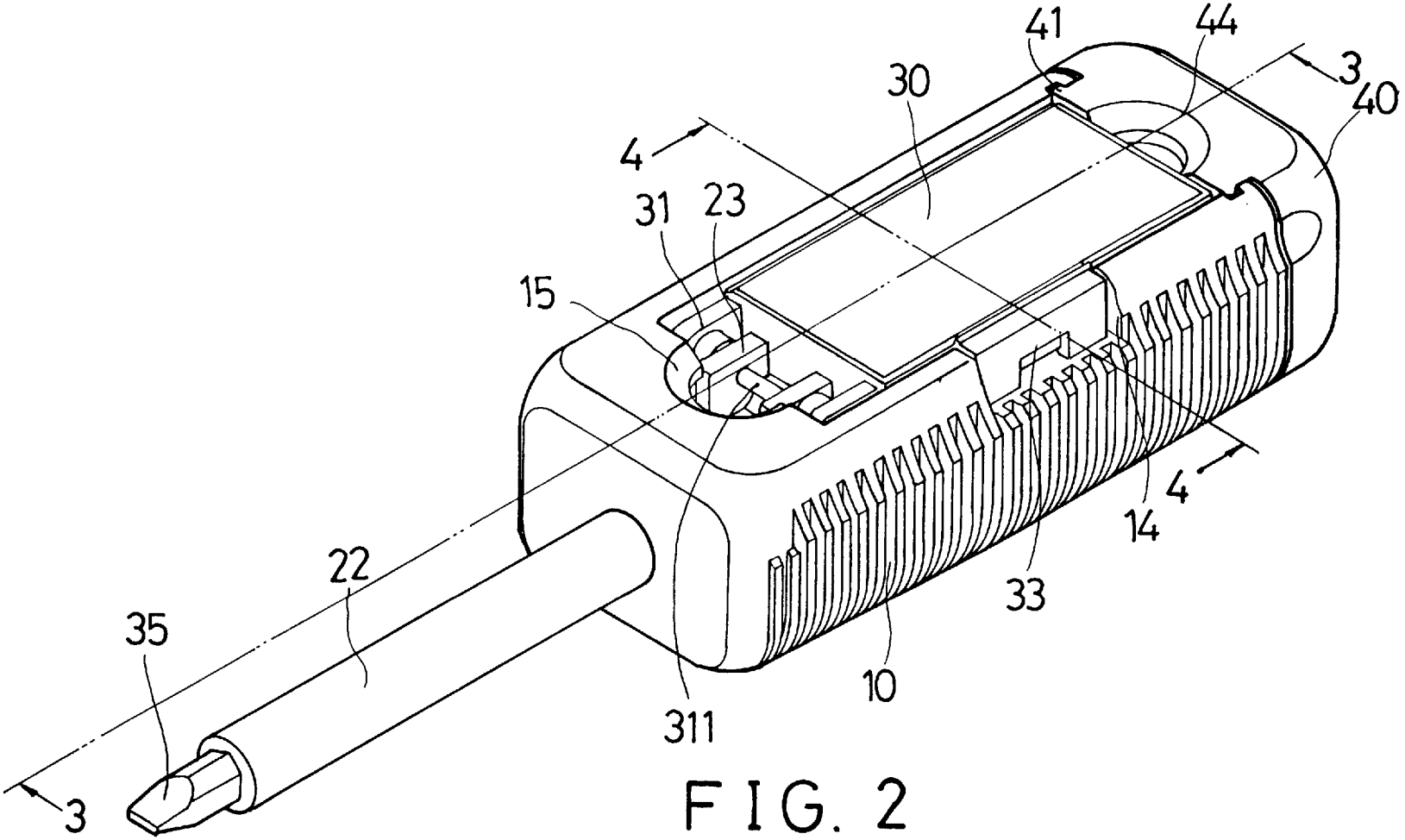
FIG. 2 is a perspective view of the tool combination.
Figure 3:
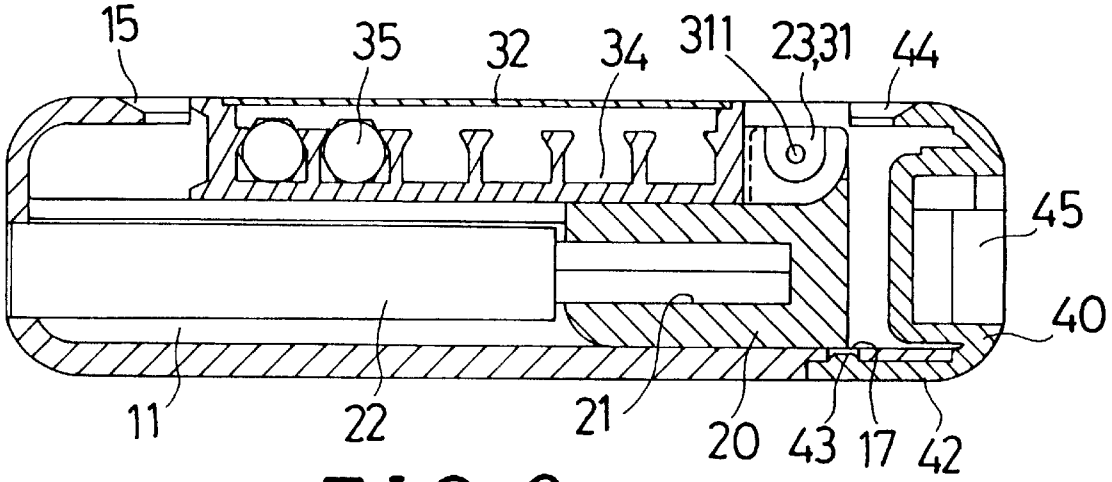
FIGS. 3 and 4 are cross sectional views taken along lines 3—3 and 4—4 of FIG. 2 respectively.
Figure 4:
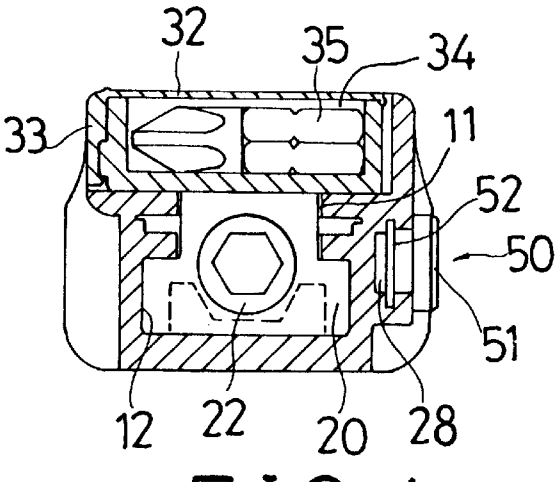
Figure 6:
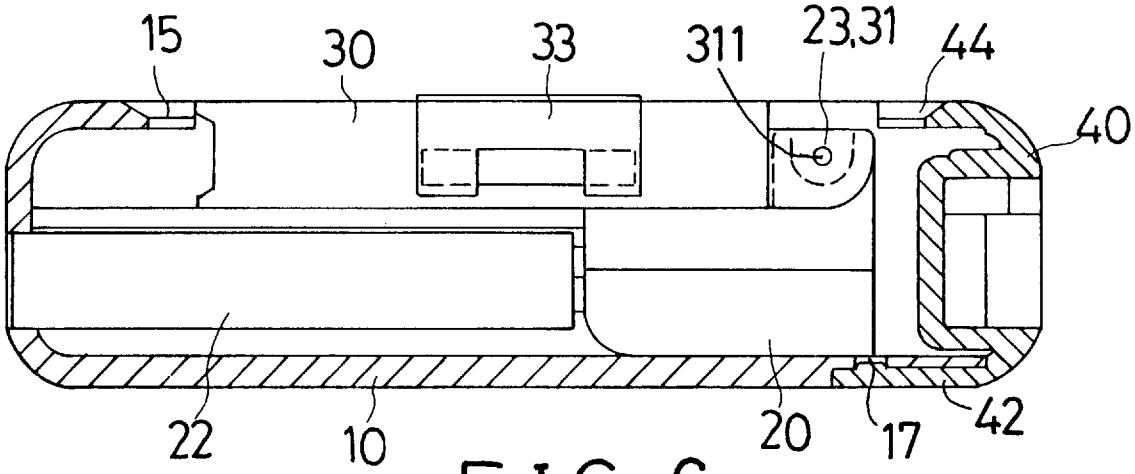
FIGS. 5 and 6 are cross sectional views similar to FIG. 3, illustrating the operation of the tool combination.

The slide 20 includes a hexagonal engaging hole 21 formed in the front end for engaging with a stem 22 which may extend outward of the body 10 through the orifice 101 and which may be engaged with a tool bit 35. The stem 22 may be engaged in the chamber 11 of the body 10 by moving the slide 20 to the rear portion of the chamber 11 (FIGS. 3, 6). The slide 20 includes two ears 23. A securing member 30 includes a pair of ears 31 pivotally coupled to the ears 23 of the slide 20 at a pivot shaft 311 for allowing the securing member 30 to be rotated about the pivot shaft 311. The securing member 30. is preferably in the form of a casing having a number of depressions 34 for receiving tool bits 35 and having a cover 32 pivotally secured to the side for enclosing the depressions 34 and for retaining the tool bits 35 in the casing. The cover 32 includes a catch 33 which may engage with the opening 14 for securing the securing member 30 in place to the body 10 (FIG. 2).

Figure 5:
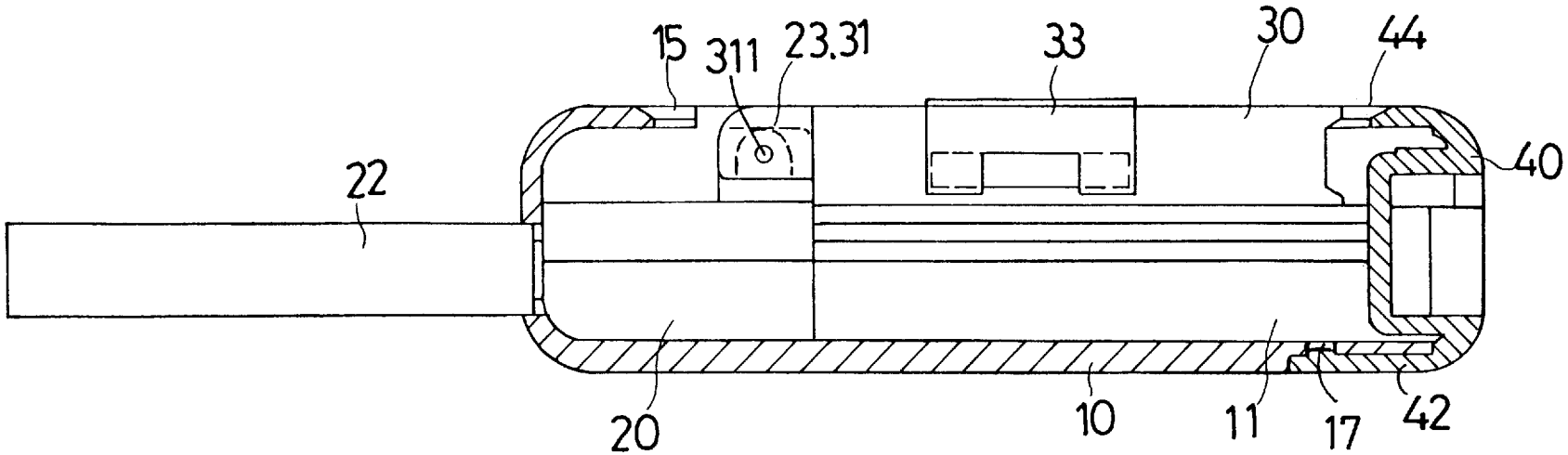
Figure 7:
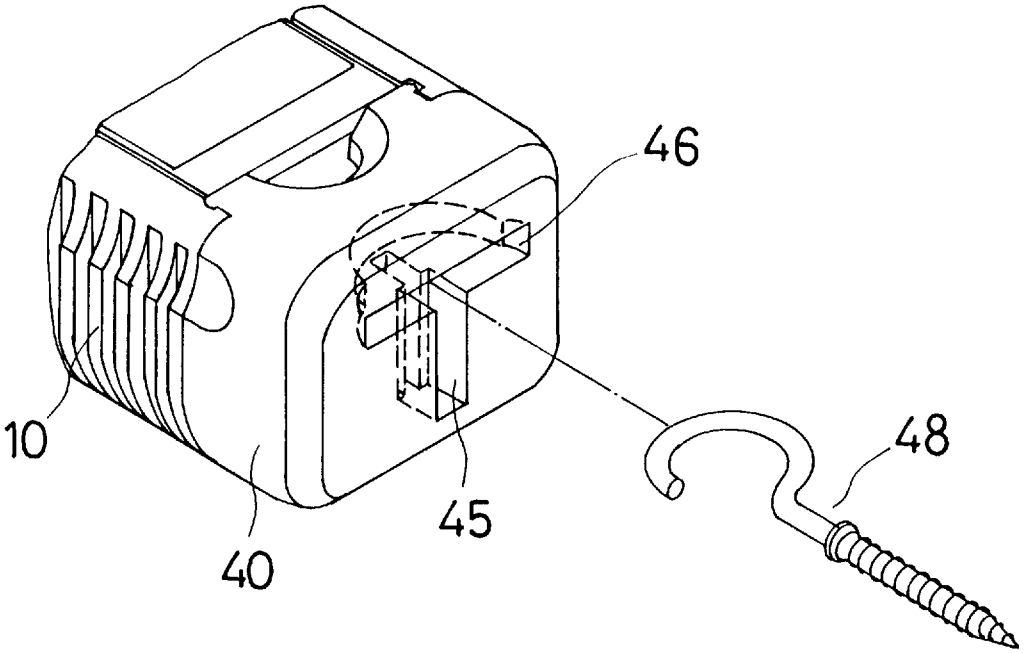
FIG. 7 is a partial rear perspective view illustrating the application of the tool combination.

In operation, as shown in FIGS. 3 and 6, when the slide 20 is rotated to the rear portion of the body 10 for receiving the stem 22 in the chamber 11 of the body 10, the securing member 30 may be engaged in the space 13 for securing the slide 20 in place and for retaining the stem 22 in the body 10. The stem 22 may also be engaged with the tool bit 35 at this moment. As shown in FIG. 2 and 5, when the securing member 30 is rotated about the pivot shaft 311 and is disengaged from the space 13, the securing member 30 may be used as a knob for moving the slide 20 along the chamber 11 and for allowing the securing member 30 to move the slide 20 to the front portion of the body 10 . The stem 22 may thus be moved outward of the body 10 by the securing member 30, and the securing member 30 may be engaged with the space 13 again for retaining the slide 20 in the front portion of the chamber 11. The recesses 15, 44 are provided for disengaging the securing member 30 from the space 13.

Referring next to FIGS. 3 and 5–7, the cap 40 includes a vertical slot 45 and/or a horizontal slot 46 for engaging with and for driving a wood screw 48.

Figure 8:
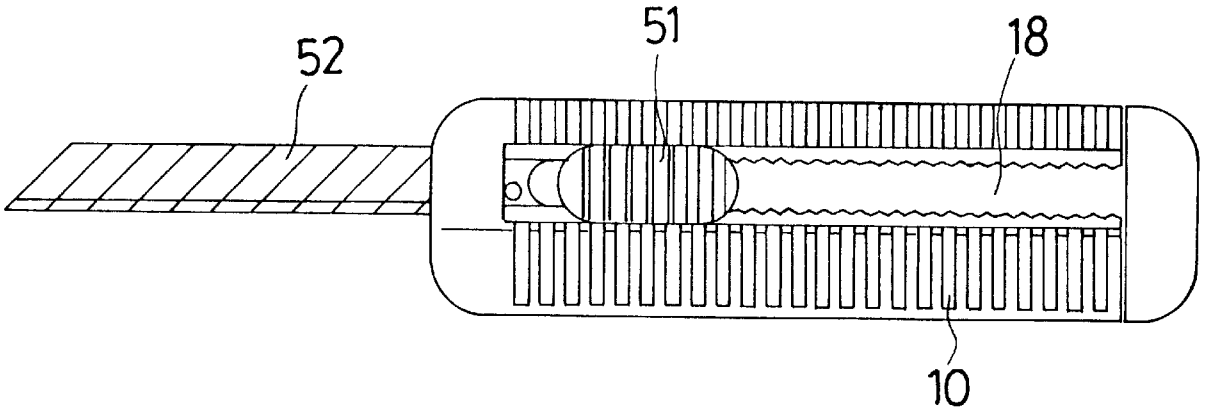
FIG. 8 is a side view illustrating the application of the tool combination as a knife.

Referring next to FIGS. 8 and 1, the body 10 includes a groove 18 formed in the side portion for slidably receiving a knife 52. A knob 51 is secured to the knife 52 for moving the knife 52 along the groove 18.

Accordingly, the tool combination in accordance with the present invention includes a stem that may be received in the body and that may be extended outward of the body for engaging with tool bits. The body also includes a knife slidably engaged in the side portion.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool combination comprising:

a body including a chamber and including a front portion having an orifice, said chamber including a front end and a rear end, said body including a space communicating with said chamber.

a slide slidably engaged in said chamber of said body for allowing said slide to move between said front end and said rear end of said chamber, a driving stem secured to said slide and moved in concert with said slide and slidably engaging with said orifice of said body for allowing said driving stem to be received in said body when said slide is moved to said rear end of said chamber and for allowing said driving stem to be extended outward of said body when said slide is moved to said front end of said chamber, and means for moving said slide along said chamber and for securing said slide to said body, said moving means including a securing member pivotally coupled to said slide at a pivot shaft for allowing said securing member to be rotated relative to said slide about said pivot shaft, said securing member being engaged in said space for securing said slide to said body.

2. The tool combination according to claim 1, wherein said body includes a side portion having an opening, said securing member includes a catch for engaging with said opening and for securing said securing member to said body.

3. The tool combination according to claim 1, wherein said securing member includes a casing having a plurality of depressions for receiving tool bits and having a cover for enclosing said depressions.

4. The tool combination according to claim 1, wherein said body includes a rear portion having at least one notch and having a puncture, and includes a cap having at least one protrusion for engaging with said at least one notch and having a projection for engaging with said puncture and for allowing said cap to be secured to said body.

5. The tool combination according to claim 4, wherein said cap includes at least one slot for engaging with a wood screw.

6. The tool combination according to claim 1, wherein said body includes a side portion having a groove, and includes a knife slidably engaged in said groove, said knife includes a knob for moving said knife along said groove.

* * * * *